US010500636B2

(12) United States Patent
Richaud et al.

(10) Patent No.: US 10,500,636 B2
(45) Date of Patent: Dec. 10, 2019

(54) CASTING NOZZLE COMPRISING FLOW DEFLECTORS

(71) Applicant: VESUVIUS USA CORPORATION, Champaign, IL (US)

(72) Inventors: Johan Richaud, Cheval Blanc (FR); Martin Kreierhoff, Suedlohn (DE); Christian Warmers, Rhede (DE)

(73) Assignee: VESUVIUS USA CORPORATION, Champaign, IL (US)

( * ) Notice: Subject to any disclaimer, the term of this patent is extended or adjusted under 35 U.S.C. 154(b) by 0 days.

(21) Appl. No.: 15/774,427

(22) PCT Filed: Nov. 8, 2016

(86) PCT No.: PCT/EP2016/076917
§ 371 (c)(1),
(2) Date: May 8, 2018

(87) PCT Pub. No.: WO2017/080972
PCT Pub. Date: May 18, 2017

(65) Prior Publication Data

US 2018/0318921 A1 Nov. 8, 2018

(30) Foreign Application Priority Data

Nov. 10, 2015 (EP) ..... 15193977

(51) Int. Cl.
*B22D 41/50* (2006.01)

(52) U.S. Cl.
CPC ..... *B22D 41/50* (2013.01)

(58) Field of Classification Search
CPC ..... B22D 41/50
See application file for complete search history.

(56) References Cited

U.S. PATENT DOCUMENTS

| | | | | |
|---|---|---|---|---|
| 5,328,064 A * | 7/1994 | Nanba | B22D 41/50 164/437 |
| 6,425,505 B1 * | 7/2002 | Heaslip | B22D 41/50 164/437 |
| 2018/0318921 A1 * | 11/2018 | Richaud | B22D 41/50 |

FOREIGN PATENT DOCUMENTS

| | | |
|---|---|---|
| CN | 201338092 Y | 11/2009 |
| CN | 102274962 A | 12/2011 |
| CN | 202539557 U | 11/2012 |
| CN | 203209685 U | 9/2013 |
| CN | 204413139 U | 6/2015 |
| EP | 0900609 A1 | 3/1993 |

* cited by examiner

*Primary Examiner* — Scott R Kastler
(74) *Attorney, Agent, or Firm* — Thomas Clinton; Donald M. Satina

(57) ABSTRACT

A casting nozzle comprises an elongated body defined by an outer wall and comprising a bore defined by a bore wall and extending along a longitudinal axis, X1, from a bore inlet to a downstream bore end, said bore comprising two opposite side ports, each extending transversally to said longitudinal axis, X1, from an opening at the bore wall defining a port inlet adjacent to the downstream bore end, to an opening at the outer wall defining a port outlet which fluidly connects the bore with an outer atmosphere. Upstream from, and directly above each port inlet, one or two flow deflectors protrude out of the bore wall and extend from an upstream deflector end remote from the port inlet to a downstream deflector end close to the port inlet.

15 Claims, 7 Drawing Sheets

CASTING NOZZLE COMPRISING FLOW DEFLECTORS

BACKGROUND OF THE INVENTION

(1) Field of the Invention

The present invention relates to continuous metal casting installations. In particular, it concerns a casting nozzle for transferring molten metal from a tundish into a mould, yielding a flow rate out of the side ports thereof which is more homogeneous both in time and between side ports than conventional casting nozzles. Bias flows and vertical fluctuations of the meniscus level in the mould are substantially reduced with a casting nozzle according to the present invention.

(2) Description of the Related Art

In continuous metal forming processes, metal melt is transferred from one metallurgical vessel to another, to a mould or to a tundish. For example, as shown in FIGS. 1 and 2, a ladle (11) is filled with metal melt out of a furnace and transferred to a tundish (10) through a ladle shroud nozzle (111). The metal melt can then be cast through a casting nozzle (1N) from the tundish to a mould for forming slabs, billets, beams, thin slabs. Flow of metal melt out of the tundish is driven by gravity through the casting nozzle (1N) and the flow rate is controlled by a stopper (7) or a tundish slide gate. A stopper (7) is a rod movably mounted above and extending coaxially (i.e., vertically) to the casting nozzle inlet orifice. The end of the stopper adjacent to the nozzle inlet orifice is the stopper head and has a geometry matching the geometry of said inlet orifice such that when the two are in contact with one another, the nozzle inlet orifice is sealed. The flow rate of molten metal out of the tundish and into the mould is controlled by continuously moving up and down the stopper such as to control the space between the stopper head and the nozzle orifice.

Control of the flow rate Q of the molten metal through the nozzle is very important because any variation thereof provokes corresponding variations of the level of the meniscus (200*m*) of molten metal formed in the mould (100). A stationary meniscus level must be obtained for the following reasons. A liquid lubricating slag is artificially produced through the melting of a special powder on the meniscus of the building slab, which is being distributed along the mould walls as flow proceeds. If the meniscus level varies excessively, the lubricating slag tends to collect in the most depressed parts of the wavy meniscus, thus leaving exposed its peaks, with a resulting null or poor distribution of lubricant, which is detrimental to the wear of the mould and to the surface of the metal part thus produced. Furthermore, a meniscus level varying too much also increases the risks of having lubricating slag being entrapped within the metal part being cast, which is of course detrimental to the quality of the product. Finally, any variation of the level of the meniscus increases the wear rate of the refractory outer walls of the nozzle, thus reducing the service time thereof.

A casting nozzle (1N) generally comprises an elongated body defined by an outer wall and comprising a bore (1) defined by a bore wall and extending along a longitudinal axis, X1, from a bore inlet (1*u*) to a downstream bore end (1*d*). In order to evenly fill the mould, casting nozzles generally comprise two opposite side ports (2), each extending transversally to said longitudinal axis, X1, from an opening at the bore wall defining a port inlet (2*u*) adjacent to the downstream bore end (1*d*), to an opening at the outer wall defining a port outlet (2*d*) which fluidly connects the bore with an outer atmosphere; in use the outer atmosphere is formed by the mould cavity, or refers to the volume exterior to the casting nozzle.

Because of complex fluid flow conditions reigning in a casting nozzle, with risks of instability at the boundary layer adjacent a bore wall, which can lead to metal flow detaching from the bore wall, and risks of formation of dead zones within the bore where the flow rate is substantially lower than in other parts of the bore, it is often observed that variations of the flow rate, Q, of molten metal out of the side ports occur as a function of time and, also, occur between one side port and the other. FIG. 3 compares the flow rate, Q1, out of a first side port (white columns); with the flow rate, Q2, out of the opposite side port (shaded columns), and also indicates the relative variation, $\Delta Q_{1-2}=|Q1-Q2|/MIN(Q1, Q2)$, wherein MIN(Q1, Q2) is the lowest value of Q1 and Q2 for a given casting nozzle. The casting nozzle labelled PA (first to the left on the abscissa), is a conventional two side port-casting nozzle, with a cylindrical bore. It can be seen that Q1=318 $dm^3$/min is substantially lower ($\Delta Q_{1-2}$=6.2%) than Q2=338 $dm^3$/min. Such asymmetrical flow pattern between the two opposite side ports is indicative of problems of flow instability in the nozzle. This can lead to uneven filling of the mould and to a meniscus of the building slab being lower at one side of the casting nozzle than at the other side, with risks of lubricant being carried into the solidifying metal slab. The difference in meniscus flow on each side of the submerged nozzle will create vortices and waves. As a consequence, temperature distribution will also be uneven.

The present invention proposes a solution allowing the stabilization of the molten metal flow in a casting nozzle bore and, in particular into the side ports. This and other advantages of the present invention are presented in the next sections.

SUMMARY OF THE INVENTION

The present invention is defined in the independent claims. Particular embodiments are defined in the dependent claims. In particular, the present invention concerns a casting nozzle comprising an elongated body defined by an outer wall and comprising a bore defined by a bore wall and extending along a longitudinal axis, X1, from a bore inlet to a downstream bore end (1*d*), said bore comprising two opposite side ports, each extending transversally to said longitudinal axis, X1, from an opening at the bore wall defining a port inlet adjacent to the downstream bore end, to an opening at the outer wall defining a port outlet which fluidly connects the bore with an outer atmosphere. The casting nozzle of the present invention may comprise more than two opposite side ports. For example, it may comprise 4 side ports, opposite two by two. The casting nozzle of the present invention is characterized in that, upstream from, and directly above each port inlet, one or two flow deflectors protrude out of the bore wall and extend from an upstream deflector end remote from the port inlet to a downstream deflector end close to the port inlet, over a deflector height, Hd, measured parallel to the longitudinal axis, X1, and wherein an area of a cross-section normal to the longitudinal axis, X1, of each flow deflector increases continuously over at least 50% of the deflector height, Hd, in the direction extending from the upstream deflector end towards the downstream deflector end.

In a particular embodiment, the area of the cross-section normal to the longitudinal axis, X1, of each flow deflector is and remains triangular or trapezoidal over at least 50% of the deflector height, Hd. The area of the cross-section normal to the longitudinal axis, X1, of each deflector advantageously increases continuously from the upstream deflector end over at least 80%, advantageously over at least 90%, advantageously over 100% of the deflector height, Hd.

In order to optimize the flow deflecting function of the flow deflectors, it is advantageous that the downstream deflector end of each flow deflector is at a distance, h, from the port inlet, wherein h is measured along the longitudinal axis, X1, and is disposed between 0 and H, advantageously between 0 and H/2, wherein H is the maximum height of the corresponding port inlet measured along the bore wall parallel to the longitudinal axis, X1.

In one embodiment, each flow deflector comprises first and second lateral surfaces, which are planar and have a triangular or trapezoidal perimeter, and form an angle, α, with one another having a value from and including 70 to and including 160°. In this embodiment each of said first and second lateral surfaces comprises a free edge remote from the bore wall, and for any cut along a plane normal to the longitudinal axis, X1, intercepting a lateral wall of a flow deflector, a straight line originating at the free edge of, and extending normal to at least one of the first and second lateral surfaces of each flow deflector advantageously intercepts a middle plane, P1, in a section disposed between the longitudinal axis, X1, and an outer perimeter defined by the outer wall of the casting nozzle, wherein the middle plane, P1, is defined as a plane comprising the longitudinal axis, X1, and normal to a line passing by the centroids of the port inlets of the two opposite side ports.

In this embodiment, each flow deflector may comprise a central surface which is planar and has a triangular, rectangular, or trapezoidal perimeter, and which is flanked on either side by the first and second lateral surfaces, joining them at their respective free edges. In a cut along a plane, fin, normal to the planar central surface and parallel to the longitudinal axis, X1, the planar central surface forms an angle, β, with a normal projection of the longitudinal axis, X1, on said plane, IIn, wherein β has a value from and including 1 to and including 15°, advantageously from and including 2 to and including 8°.

In an alternative embodiment, the free edges of the first and second lateral surfaces join to form a rectilinear ridge. In a cut along a plane, IIb, comprising said rectilinear ridge and bisecting the angle, α, formed by the first and second lateral surfaces the rectilinear ridge advantageously forms an angle, γ, with a normal projection of the longitudinal axis, X1, on said plane, IIb, wherein γ has a value from and including 1 to and including 15°, advantageously from and including 2 to and including 8°.

In a particular embodiment, the casting nozzle comprises two flow deflectors upstream from each port inlet. The two flow deflectors are advantageously contiguous to each side port. For any cut along a plane normal to the longitudinal axis, X1, intercepting the first and second lateral walls of a flow deflector, a first straight line originating at the free edge of, and extending normal to the first lateral surface of each flow deflector advantageously intercepts the middle plane, P1, in a section disposed between the longitudinal axis, X1, and the outer perimeter, wherein P1 is as defined supra, and a second straight line originating at the free edge of, and extending normal to the second lateral surface of each flow deflector advantageously intercepts a central plane, P2, in a section disposed between the longitudinal axis, X1, and the outer perimeter, wherein the central plane, P2, includes the longitudinal axis, X1, and is normal to P1.

In an alternative embodiment, the casting nozzle comprises a single flow deflector upstream from each port inlet. Said single flow deflector is advantageously contiguous to the corresponding flow port. For any cut along a plane normal to the longitudinal axis, X1, intercepting the first and second lateral walls of a flow deflector, straight lines originating at the free edges of, and extending normal to the first and second lateral surfaces of each deflector advantageously intercept the middle plane, P1, in a first and second sections located on either sides of the longitudinal axis, X1, and disposed between the longitudinal axis, X1, and the outer perimeter.

A casting nozzle according to the present invention may also comprise two edge ports protruding out of the bore wall and extending upstream from the downstream bore end (2*d*) to above the level of the port inlet, the two edge ports facing each other and being located between the port inlets of the two side ports.

BRIEF DESCRIPTION OF THE SEVERAL VIEWS OF THE DRAWINGS

Various embodiments of the present invention are illustrated in the attached Figures.

Figure 1:
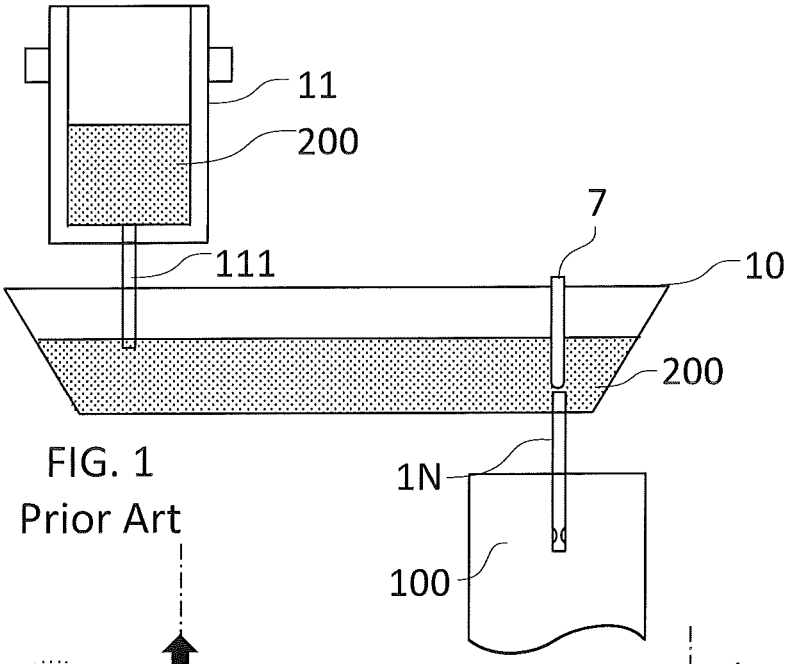
FIG. 1 Prior Art
FIG. 1: schematically illustrates a continuous metal casting installation.

The invention is not limited to the embodiments illustrated in the drawings. Accordingly, it should be understood that where features mentioned in the appended claims are followed by reference signs, such signs are included solely for the purpose of enhancing the intelligibility of the claims and are in no way limiting the scope of the claims.

DETAILED DESCRIPTION OF THE INVENTION

Figure 2A:
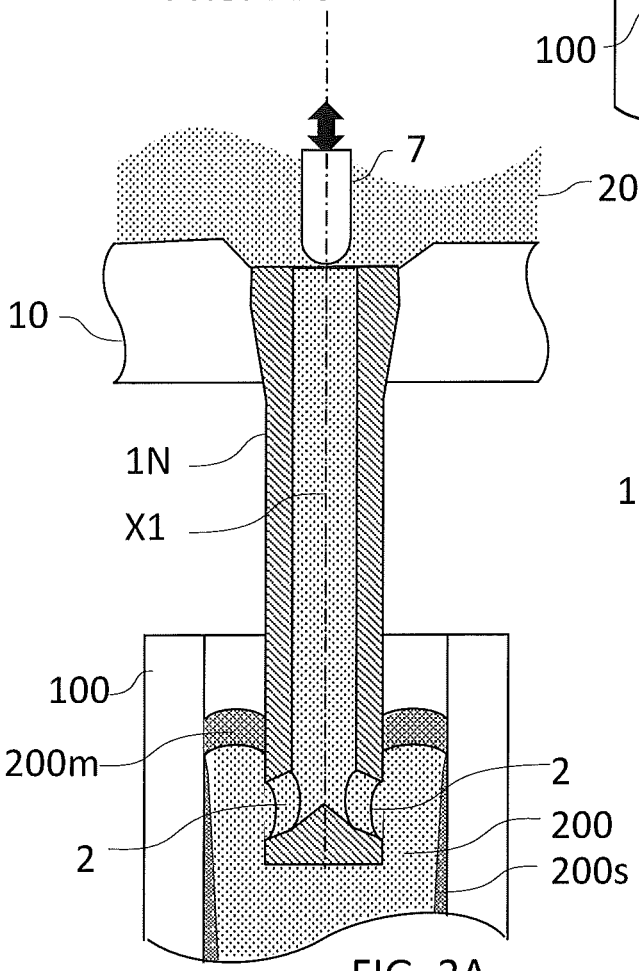
FIG. 2A Prior Art
FIG. 2: shows (a) a detail of FIG. 1, illustrating a casting nozzle coupled to a tundish and partially engaged in a mould, and (b) a perspective view of a casting nozzle.
Figure 2B:
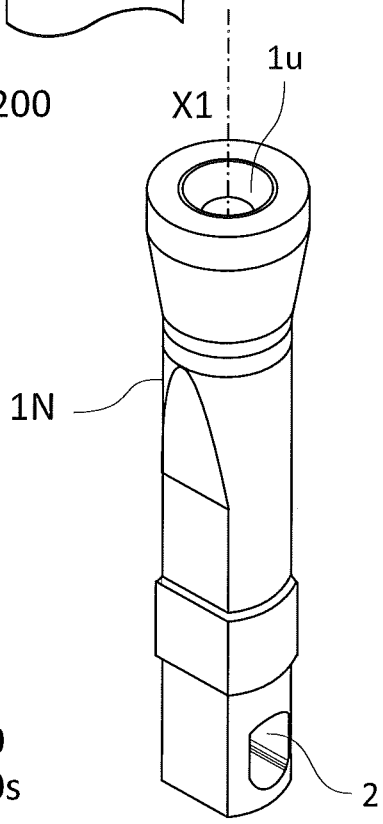
FIG. 2B Prior Art

The present invention concerns casting nozzles (1N) used, as can be seen in FIGS. 1 and 2, for transferring molten metal (200) from a tundish (10) into a mould (100). The casting nozzles of the present invention yield a more stable and homogeneous flow of molten metal into a mould, with a vertical level of the meniscus (200*m*) formed in the mould at the top of the molten metal which remains stable during the casting operation.

A nozzle according to the present invention is of the type comprising an elongated body defined by an outer wall and comprising a bore (1) defined by a bore wall and extending along a longitudinal axis, X1, from a bore inlet (1*u*) to a downstream bore end (1*d*). The bore comprises two opposite side ports (2), each extending transversally to said longitudinal axis, X1, from an opening at the bore wall defining a port inlet (2*u*) adjacent to the downstream bore end (1*d*), to an opening at the outer wall defining a port outlet (2*d*) which fluidly connects the bore with an outer atmosphere. The outer atmosphere defines any atmosphere surrounding the outer wall of the casting nozzle at the level of the port outlets. In use during a casting operation, the outer atmosphere is formed by molten metal filling the casting mould up to above the level of the side ports (see FIG. 2(*a*)). A casting nozzle according to the present invention may comprise more than two opposite side ports. For example, it may comprise four side ports opposite two by two.

The gist of the present invention consists of providing upstream from, and directly above each port inlet (2*u*), one or two flow deflectors (3), which protrude out of the bore wall and extend from an upstream deflector end remote from the port inlet to a downstream deflector end close to the port inlet, over a deflector height, Hd, measured parallel to the longitudinal axis, X1. The expression "directly above" means herein that there is no protrusion or recess between the downstream deflector end of a flow deflector and the corresponding port inlet. The downstream deflector end is advantageously contiguous to the corresponding port inlet.

Figure 9A:
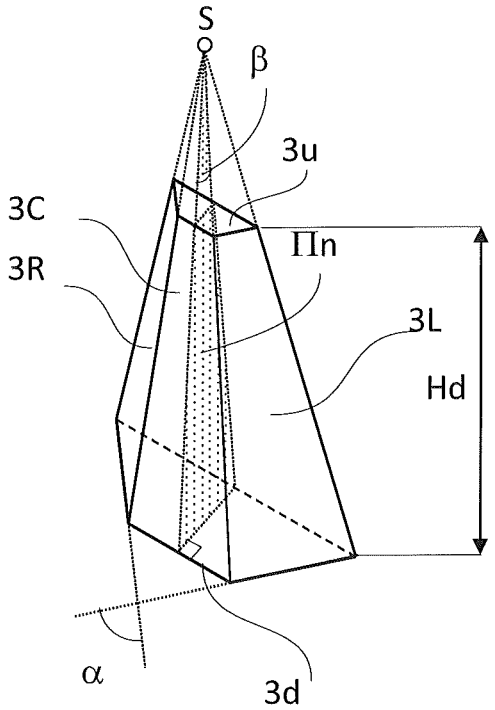
FIG. 9: shows different embodiments of flow deflectors according to the present invention.

The area of a cross-section normal to the longitudinal axis, X1, of each flow deflector increases continuously over at least 50% of the deflector height, Hd, in the direction extending from the upstream deflector end towards the downstream deflector end. Advantageously it increases continuously over at least 80%, advantageously over at least 90% of Hd. Advantageously it increases continuously over 100% of the deflector height, Hd, as illustrated in FIG. 9(*a*) to (*c*). In FIG. 9(*a*)&(*b*), the cross-sectional area increases linearly over the whole height, Hd, of the flow deflector, whilst in FIG. 9(*c*), the cross-sectional area increases continuously, but not linearly. FIG. 9(*c*) illustrates an embodiment wherein at one point located at a distance greater than 50% of Hd from the upstream deflector end, the cross-section decreases until the downstream deflector end. Whenever used, the terms "upstream" and "downstream" are defined with respect to a flow from the bore inlet (1*u*) towards the port outlets (2*d*).

The cross-section of a flow deflector along a plane normal to the longitudinal axis is advantageously and advantageously remains triangular or trapezoidal over at least 50%, advantageously over at least 80%, advantageously at least over 90% of the deflector height, Hd. In a particular embodiment, said cross-section is and remains triangular or trapezoidal over the whole height (=100%), Hd, of the flow deflector, as illustrated in FIGS. 4 to 9 and 11. Flow deflectors as illustrated in FIG. 9 have a nose-like geometry, with a first and second non-parallel lateral surfaces (3R, 3L) joining either to one another to form a ridge as illustrated in FIG. 9(*b*)&(*c*), or at two opposite sides of a central surface (3C) forming an edge, as shown in FIG. 9(*a*). The central surface (3C) can be planar as depicted in FIG. 9(*a*), or can be curved as shown in FIG. 9(*c*).

The downstream deflector end of a flow deflector must be located directly above (or upstream from) the corresponding port inlet. In a particular embodiment, the downstream deflector end is contiguous to said port inlet, forming a lip of the port inlet, as shown, e.g., in FIGS. 4 to 8. The downstream deflector end can also be located directly above the corresponding port inlet at a distance, h, from the port inlet, wherein, as illustrated in FIG. 11(*b*), the distance, h, is measured along the longitudinal axis, X1, and has a value from and including 0 to and including H, advantageously from and including 0 to and including H/2, wherein H is the maximum height of the corresponding port inlet measured along the bore wall parallel to the longitudinal axis, X1. If the downstream deflector end of a flow deflector is located at a distance, h>H, the effect of the flow deflectors discussed below of stabilizing the molten metal flow before exiting the bore through the side ports (2) is decreased. A low value of the distance, h, is therefore advantageous, with a particular value of h having a value from and including 0 to and including 30 mm, particularly from and including 0 to and including 15 mm; and more particularly, h=0, defining a downstream deflector end which is contiguous to the corresponding port inlet.

Figure 8:
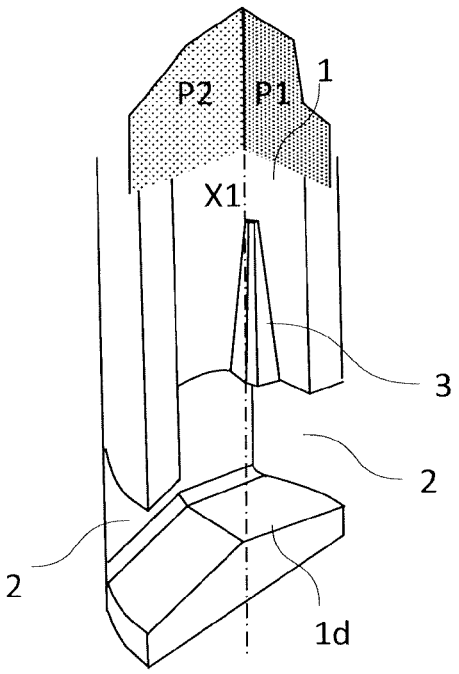
FIG. 8: shows a perspective cut view of the casting nozzle of FIG. 6.
Figure 10A:
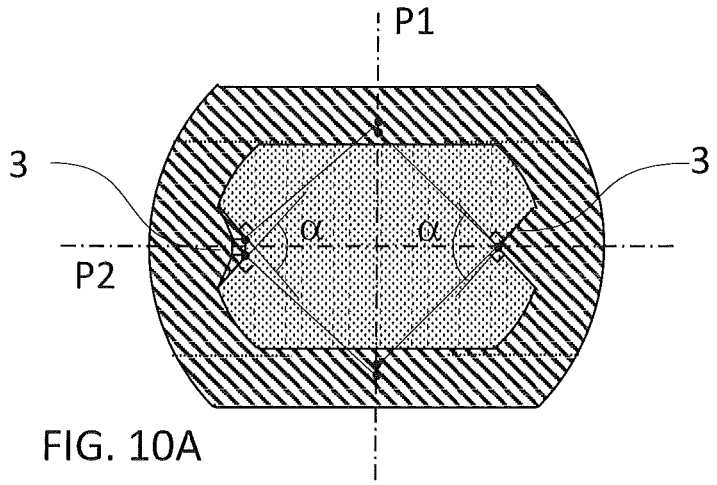
FIG. 10: shows cut views along a plane normal to X1, of two embodiments, showing the cross-section of the flow deflectors.
Figure 10B:
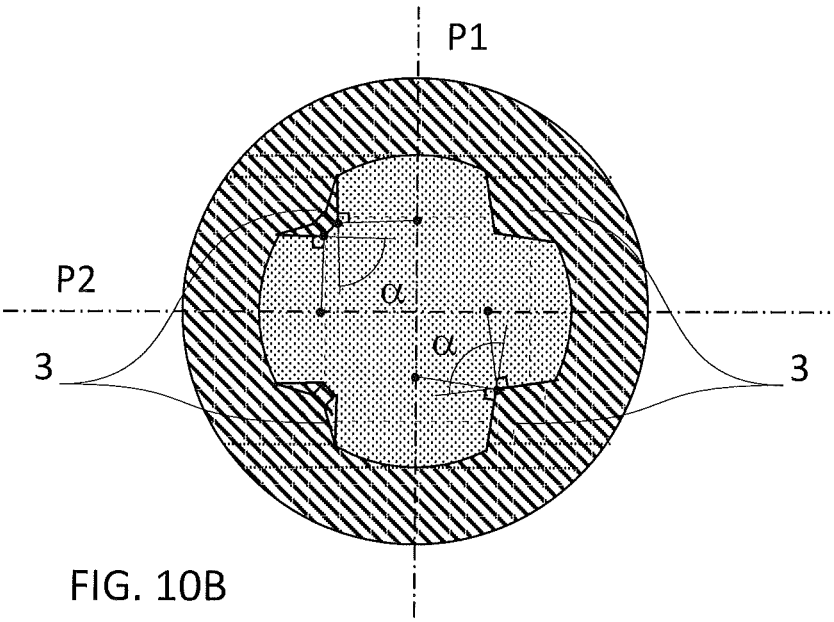
Figure 11A:
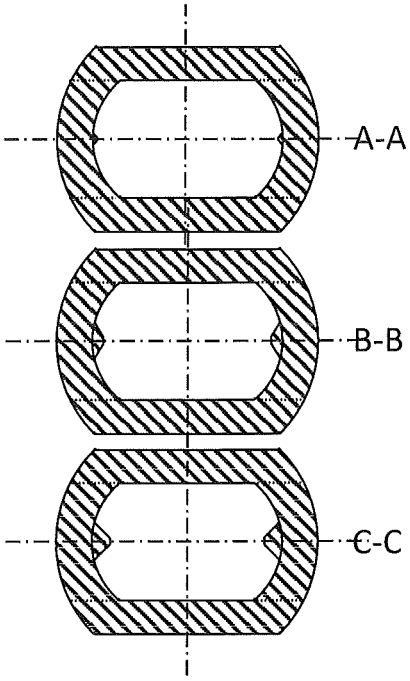
FIG. 11: shows a side cut view and three cuts along planes normal to the longitudinal axis, X1, including the flow deflectors in (a) a first and (b) a second embodiment of nozzles according to the present invention.
Figure 11A:
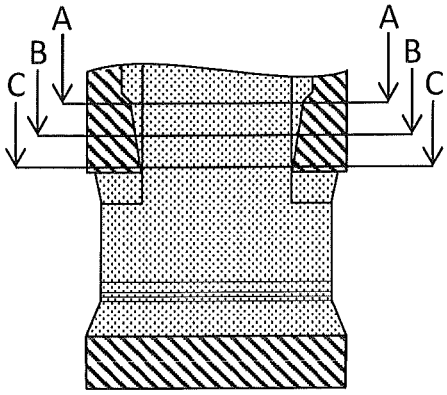
Figure 11B:
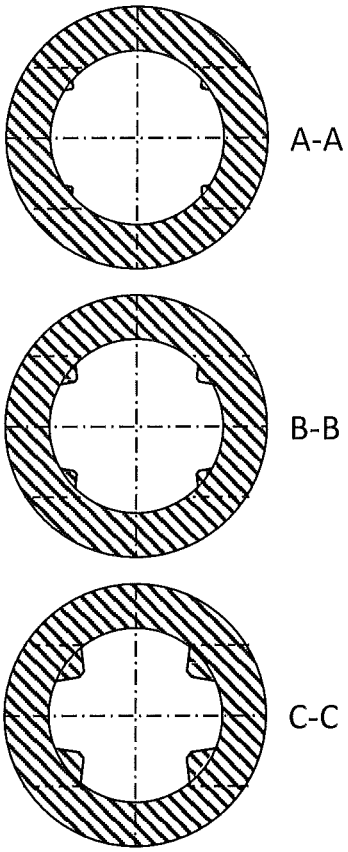
Figure 11B:
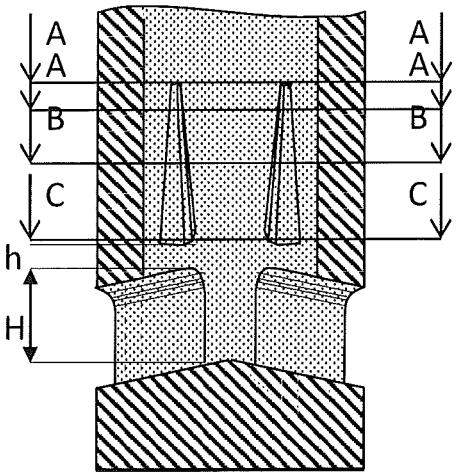

As Illustrated in FIGS. 8 and 10, a middle plane, P1, can be defined as a plane comprising the longitudinal axis, X1, and normal to a line passing by the centroids of the port inlets of the two opposite side ports (2). A central plane, P2, can be defined as a plane including the longitudinal axis, X1, and the centroids of each of the port inlets, P1, is therefore normal to P2 and intercept at the longitudinal axis, X1.

As mentioned supra, the flow deflectors have a nose like geometry with first and second lateral surfaces (3L, 3R). In a particular embodiment, said first and second lateral surfaces are substantially planar, forming a triangular or a quadrilateral perimeter with at least two opposite non-parallel edges, advantageously a trapezoidal perimeter. The first and second lateral surfaces converge towards one another from the bore wall, forming an angle, α, with one another from and including 70 to and including 160° (cf. FIG. 9).

Figure 9B:
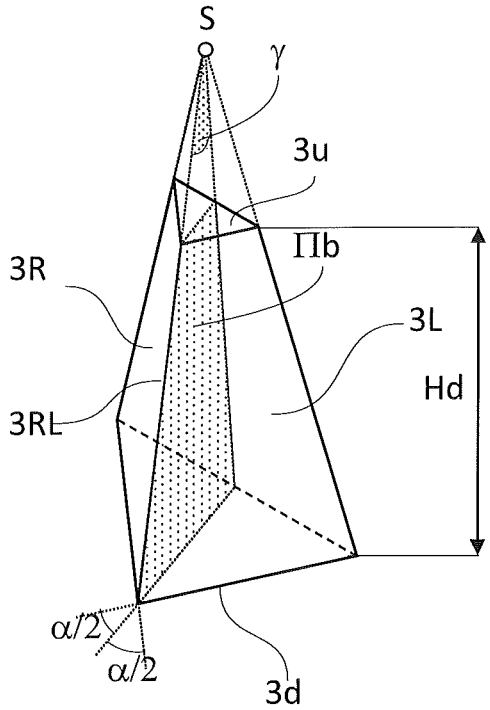
Figure 9C:
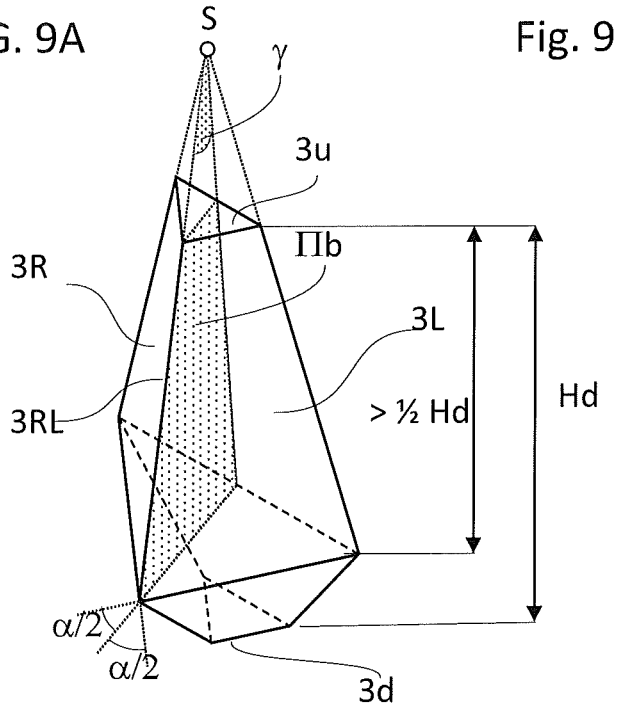

Each of said first and second lateral planar surfaces comprises a free edge remote from the bore wall. The two lateral surfaces may meet at their respective free edges to form a ridge (3RL) which, as illustrated in FIG. 9*b*), can be rectilinear or, at least, can comprise a rectilinear section as shown in FIG. 9*c*). Such flow deflector has a triangular cross-section normal to X1 and is referred to as "triangular flow deflector" in reference with the cross-section thereof. Alternatively, the lateral surfaces can be separated by a central surface (3C) which can be planar (cf. FIG. 9(*a*)) or can comprise a planar portion (cf. FIG. 9*c*)), and has a triangular, rectangular, or trapezoidal perimeter. The central surface is flanked on either side by the first and second lateral surfaces (3R, 3L), joining them at their respective free edges, as shown in FIG. 9(*a*)&(*c*). Such flow deflector has a trapezoidal cross-section normal to X1 and is referred to as "trapezoidal flow deflector" in reference with the cross-section thereof. If the central surface is curved as depicted in FIG. 9*c*), the cross-section normal to X1 can be referred to as "quasi-trapezoidal", and such flow deflector can be referred to as "quasi-trapezoidal flow deflector".

As shown in FIG. 9(*b*)&(*c*), the rectilinear ridge or a rectilinear ridge section of a triangular flow deflector is not parallel to the bore wall and forms a slope defined by an angle, γ, from and including 1 to and including 15°, advantageously from and including 2 to and including 8°, wherein β is measured between said rectilinear ridge and a normal projection of the longitudinal axis, X1, on a plane, Πb, including said rectilinear ridge (section) and bisecting the angle, α, formed by the first and second lateral surfaces (3R, 3L). The angle γ defines the slope of a nose like triangular flow deflector.

Similarly and as shown in FIG. 9(*a*), the slope of the planar central surface (3C) or planar central surface portion of a trapezoidal flow deflector is not parallel to the bore wall and forms a slope defined by an angle, β, from and including 1 to and including 15°, advantageously from and including 2 to and including 8°, wherein β is measured between said planar central surface (portion) and a normal projection of the longitudinal axis, X1, on a plane, fin, normal to the planar central surface (3C) and parallel to the longitudinal axis, X1. The angle β defines the slope of a nose like trapezoidal flow deflector.

As shown in FIG. 10, it is advantageous that for any cut along a plane normal to the longitudinal axis, X1, intercepting a lateral wall of a flow deflector, a straight line originating at the free edge of, and extending normal to at least one of the first and second lateral surfaces of each flow deflector intercepts the middle plane, P1, in a section disposed between the longitudinal axis, X1, and an outer perimeter defined by the outer wall of the casting nozzle.

Figure 4:
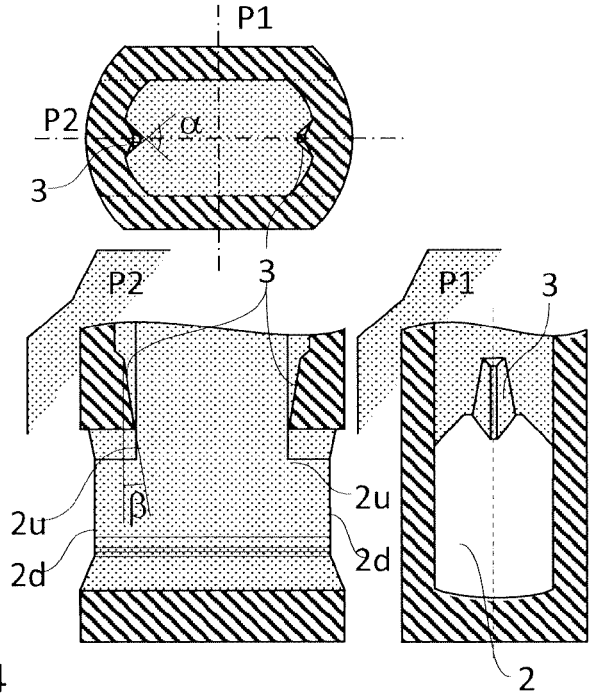
FIG. 4: shows a first embodiment of a nozzle according to the present invention comprising two flow deflectors.
Figure 5:
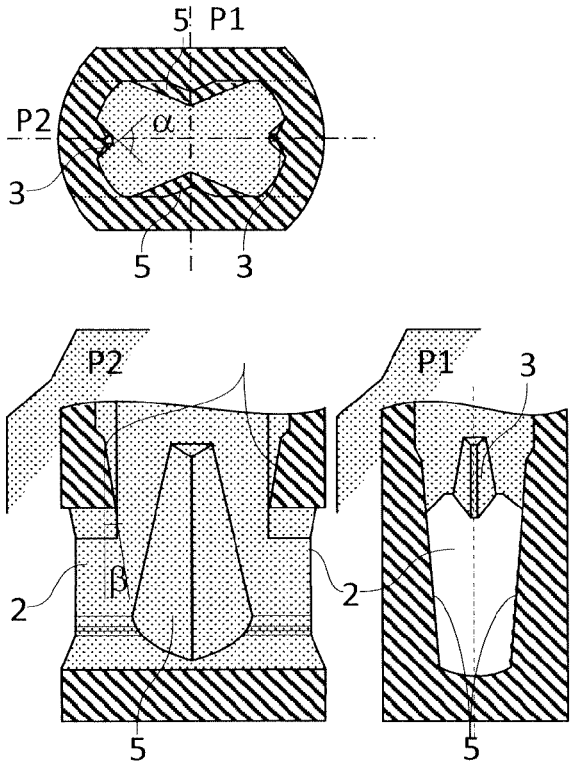
FIG. 5: shows an alternative embodiment of a nozzle according to the present invention comprising two flow deflectors and two edge ports.

In a particular embodiment, the casting nozzle comprises a single flow deflector (4) upstream from and advantageously contiguous to each port inlet (2*u*), as illustrated in FIGS. 4, 5, 10(*a*), and 11(*a*). In this embodiment illustrated in FIG. 10(*a*), the straight lines originating at the free edge of, and extending normal to the first and second lateral surfaces of each flow deflector intercept the middle plane, P1, in a first and second sections located on either sides of the longitudinal axis, X1, and disposed between the longitudinal axis, X1, and the outer perimeter.

With this configuration, the flow is deflected towards the bore wall, pushed along the walls of the side ports, thus preventing the formation of secondary flows. In particular, the flow deflected towards the side wall of the port is split evenly between the two side ports (2), thus removing any bias flow behaviour inside the bore.

In an alternative embodiment, the casting nozzle comprises two flow deflectors (4) upstream from each port inlet (2*u*) and advantageously contiguous thereto, as illustrated in FIGS. 6 to 8, 10(*b*), and 11(*b*). In this embodiment illustrated in FIG. 10(*b*),

- a first straight line originating at the free edge of, and extending normal to the first lateral surface of each flow deflector intercepts the middle plane, P1, in a section disposed between the longitudinal axis, X1, and the outer perimeter, and
- a second straight line originating at the free edge of, and extending normal to the second lateral surface of each flow deflector intercepts the central plane, P2, in a section disposed between the longitudinal axis, X1, and the outer perimeter.

Like in the embodiment comprising a single flow deflector above each side port discussed supra, the flow deflected towards the bore wall by the first lateral surface prevents the formation of bias flow. Bias flow formation is also reduced by centering the flow towards the central plane, P2, by means of the second lateral surface. Bias flow formation is a problem commonly encountered when using large nozzle bores even in presence of an edge port. The flow deflected towards the central plane, P2, by the second lateral surface also yields a better jet stability, with reduced vertical fluctuations of the side port exiting jets. The deflection of the flow towards the central plane, P2, also guides the gas bubbles to be entrained by the side port exiting jets.

Figure 3:
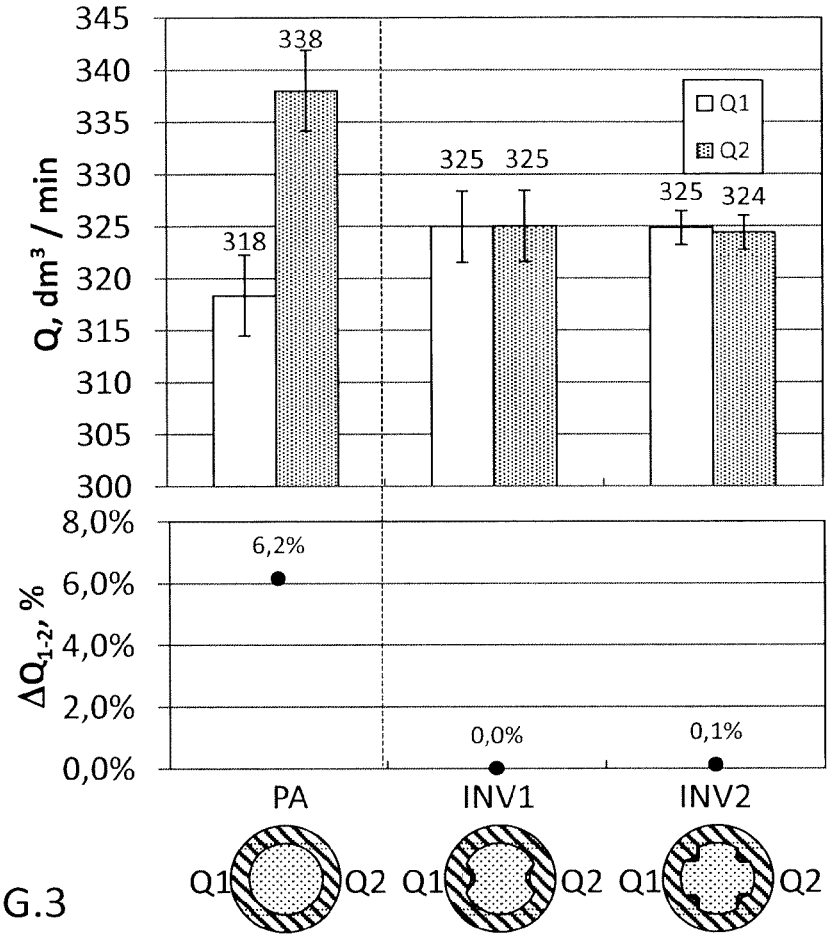
FIG. 3: graphically compares the flow rates, Q1 and Q2, between a first side port and the other for a conventional casting nozzle of the prior art (PA) and two embodiments of the present invention (INV1, INV2)

The enhancement of the flow control out of the side ports by the flow deflectors (3) is demonstrated in FIG. 3, plotting the flow rates, Q1 (white columns) and Q2 (shaded columns), out of a first side port and a second side port, respectively, measured on three different casting nozzles each having a bore with a circular cross section: (a) a casting nozzle according to the prior art, devoid of any flow deflector, (b) a casting nozzle according to the present invention (INV1) comprising a single flow deflector above each side port, and (c) a casting nozzle according to the present invention (INV2) comprising two flow deflector above each side port. The relative flow difference, $\Delta Q_{1-2}=|Q1-Q2|/MIN(Q1, Q2)$, between the first and second flow ports is also plotted (black circles) for each nozzle. It can be seen that the flow rate difference, $\Delta Q_{1-2}$, between the first and second flow ports of a prior art casting nozzle (a) reaches 6.2%, with a flow rate, Q2, out of the second side port which is 20 $dm^3$/min higher than the flow rate, Q1, out of the first side port. Such asymmetry in the flow behaviour out of a casting nozzle into a mould can be a source of inhomogeneity in the final slab thus formed.

By contrast, the presence of one or two deflectors (b, c) above each side port reduces the difference between Q1 and Q2 to practically zero, yielding a symmetrical flow out of the casting nozzle into a mould. As discussed above, vertical flow fluctuations are substantially reduced by deflecting part of the flow towards the central plane, P2, which is shown by the lower standard deviation measured on casting nozzles comprising two flow deflectors above each side port.

In order to promote the flow deflection, it is advantageous that the upstream deflector end (3*u*) of the flow deflectors have a non-zero cross-sectional area normal to the longitudinal axis, X1. Referring to FIG. 9, though the upstream deflector end (3*u*) could be formed at the summit, S, forming a zero cross-sectional area normal to X1, it is advantageous that the upstream deflector end forms downstream from said summit, S, a surface against which the incoming metal flow impacts. The upstream deflector end (3*u*) can form a surface normal to X1 as illustrated in FIG. 9(*a*), but it can also form a slope descending downstream from the bore wall to the central edge (3C) or ridge (3RL) of the flow deflector, as shown in FIG. 9(*c*). A cross-sectional area normal to X1 of the upstream deflector end advantageously protrudes out of the bore wall by a distance of 1 to 10 mm, advantageously of 2 to 6 mm, advantageously of 4±1 mm, measured normal to the bore wall. Such dimensions are several times larger than the boundary layers forming at the bore wall. FIG. 11 shows in the cut A-A examples of upstream deflector ends (3*u*) having a non-zero cross-sectional area.

Figure 7:
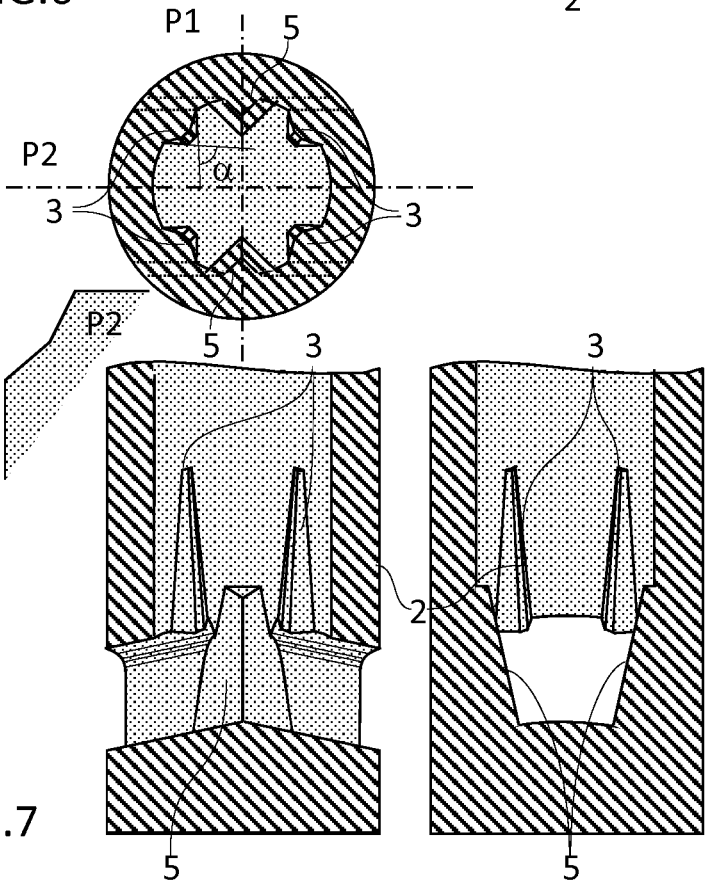
FIG. 7: shows an alternative embodiment of a nozzle according to the present invention comprising four flow deflectors and two edge ports.

In a particular embodiment, a casting nozzle further comprises two edge ports (5) protruding out of the bore wall and extending upstream from the downstream bore end (2*d*) to above the level of the port inlet (2*u*), the two edge ports facing each other and being located between the port inlets (2*u*) of the two side ports. It is advantageous that the edge ports (5) be symmetrical with respect to the middle plane, P1, as illustrated in FIGS. 5 and 7. Edge ports are traditionally used for stabilizing the flow out of a casting nozzle. Edge ports alone, however, cannot reduce substantially bias flow formation, in particular for casting nozzles having a large size bore. They also have a nose-like geometry with two lateral edge surfaces forming an angle from and including 70 to and including 160°. The lateral edges may meet to form a ridge, or they can be separated by a planar central plane of triangular, rectangular or trapezoidal geometry. Edge ports may extend from the bore end (1*u*) (i.e., the bottom floor of the bore) up along the longitudinal axis, X1, above the level of the bore inlets.

The effect of edge ports (5) is enhanced by the presence of flow deflectors (3) as non-linear flow paths are formed as the metal melt bounces successively against a lateral surface of a flow deflector and on a lateral edge surface of an edge port, before exiting through a side port. This increases the local pressure in the liquid melt, thus further reducing turbulence and bias flows exiting the ports.

Figure 6:
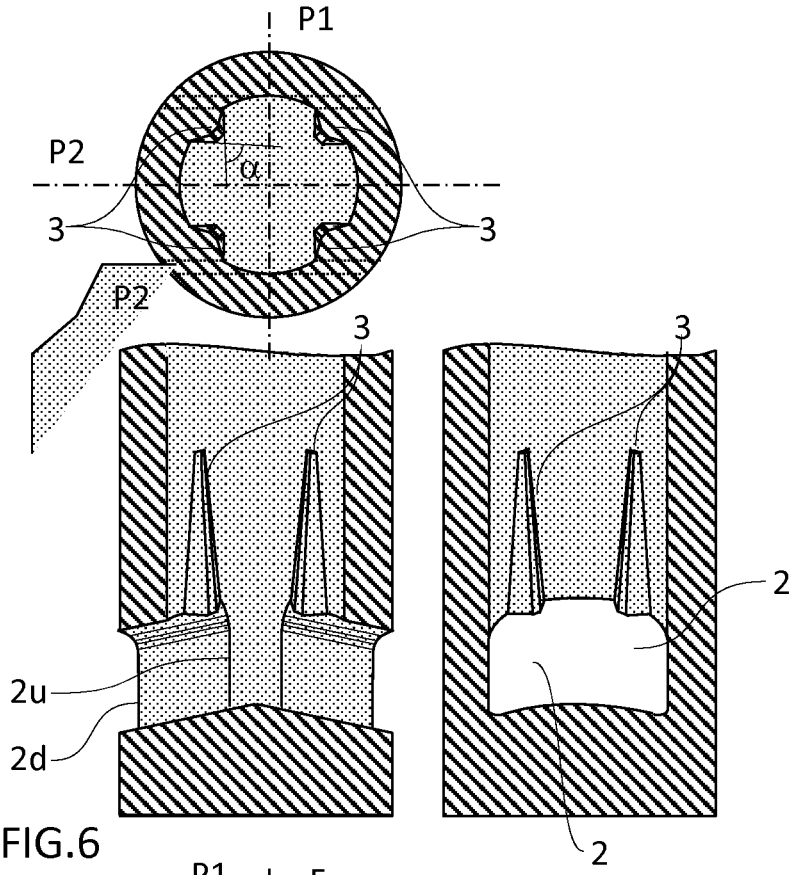
FIG. 6: shows an alternative embodiment of a nozzle according to the present invention comprising four flow deflectors.

The bore end (1*d*) or bore floor can be substantially planar and normal to the longitudinal axis, as shown in FIGS. 4, 5, and 11(*a*). It may be flush and continuous with a bottom floor of the side ports (2). In an alternative embodiment, the bore end (1*d*) comprises two bore end portions meeting at an apex forming a ridge comprised within the middle plane, P1, and sloping downwards towards the side ports, as illustrated in FIGS. 6, 7, and 11(*b*). Again the bottom floors of the side ports are advantageously flush and continuous (parallel to) with the bore end portions to ensure a smooth and "quasi-laminar" flow out of the side ports.

A casting nozzle according to the present invention is advantageous over prior art casting nozzles in that the flow out of the first and second side ports is balanced, with an equal flow rate, Q1, Q2, out of the first and second side ports, and fluctuates substantially less in time, yielding beams having a greater homogeneity and reproducibility.

| Ref | Description |
|---|---|
| 1 | Bore |
| 1d | bore end |
| 1N | casting nozzle |
| 1u | bore inlet |
| 2 | side port |
| 2d | side port outlet |
| 2u | side port inlet |
| 3 | flow deflector |
| 3C | central surface of a flow deflector |
| 3d | downstream end surface of a flow deflector |
| 3L | second lateral surface of a flow deflector |
| 3R | first lateral surface of a flow deflector |
| 3RL | ridge formed by joining first and second surfaces |
| 3u | upstream end surface of a flow deflector |
| 5 | edge port |
| 7 | Stopper |
| 10 | Tundish |
| 11 | Ladle |
| 100 | Mould |
| 111 | ladle shroud nozzle |
| 200 | molten metal |
| 200m | metal meniscus |
| Hd | Height of flow deflector measured parallel to X1 |
| X1 | Longitudinal axis |
| P1 | Middle plane including X1 and normal to P2 |
| P2 | Central plane including X1 and centroids of port inlets (2u) |
| Πb | plane bisecting the angle, a, formed by planar first and second surfaces |
| Πn | plane normal to a planar central surface |
| α | angle formed by planar first and second surfaces |
| β | angle formed by projections of central surface and X1 onto plane Πn |
| γ | angle formed by ridge and projection of X1 onto plane Πb |

We claim:

1. Casting nozzle comprising an elongated body defined by an outer wall and comprising a bore defined by a bore wall and extending along a longitudinal axis, X1, from a bore inlet to a downstream bore end, said bore comprising two opposite side ports, each extending transversally to said longitudinal axis, X1, from an opening at the bore wall defining a port inlet adjacent to the downstream bore end, to an opening at the outer wall defining a port outlet which fluidly connects the bore with a casting nozzle exterior, wherein, upstream from, and directly above each port inlet, a number of flow deflectors selected from the group consisting of one and two protrudes out of the bore wall and extends from an upstream deflector end remote from the port inlet to a downstream deflector end close to the port inlet, over a deflector height, Hd, measured parallel to the longitudinal axis, X1, and wherein an area of a cross-section normal to the longitudinal axis, X1, of each flow deflector increases continuously over at least 50% of the deflector height, Hd, in the direction extending from the upstream deflector end towards the downstream deflector end.

2. Casting nozzle according to claim 1, wherein the area of the cross-section normal to the longitudinal axis, X1, of each flow deflector is and remains in a geometry selected from the group consisting of triangular or trapezoidal over at least 50% of the deflector height, Hd.

3. Casting nozzle according to claim 1, wherein the area of the cross-section normal to the longitudinal axis, X1, of each deflector increases continuously from the upstream deflector end over at least 80% of the deflector height, Hd, and wherein said area is and remains triangular or trapezoidal over at least 80% of the deflector height, Hd.

4. Casting nozzle according to claim 1, wherein the downstream deflector end of each flow deflector is at a distance, h, from the port inlet, wherein h is measured along the longitudinal axis, X1, and has a value from and including 0 to and including H, wherein H is the maximum height of the corresponding port inlet measured along the bore wall parallel to the longitudinal axis, X1.

5. Casting nozzle according to claim 1, wherein each flow deflector comprises first and second lateral surfaces which are planar and have a triangular or trapezoidal perimeter, and form an angle, α, with one another having a value from and including 70° to and including 160°.

6. Casting nozzle according to claim 5, wherein:

a middle plane, P1, is defined as a plane comprising the longitudinal axis, X1, and normal to a line passing by the centroids of the port inlets of the two opposite side ports, each of said first and second lateral surfaces comprises a free edge remote from the bore wall, and for any cut along a plane normal to the longitudinal axis, X1, intercepting a lateral wall of a flow deflector, a straight line originating at the free edge of, and extending normal to at least one of the first and second lateral surfaces of each flow deflector intercepts the middle plane, P1, in a section comprised between the longitudinal axis, X1, and an outer perimeter defined by the outer wall of the casting nozzle.

7. Casting nozzle according to claim 5, wherein each flow deflector comprises a central surface which is planar and has a triangular, rectangular, or trapezoidal perimeter, and which is flanked on either side by the first and second lateral surfaces, joining them at their respective free edges.

8. Casting nozzle according to claim 7, wherein in a cut along a plane, fin, normal to the planar central surface and parallel to the longitudinal axis, X1, the planar central surface forms an angle, β, with a normal projection of the longitudinal axis, X1, on said plane, fin, wherein β has a value from and including 1° to and including 15°.

9. Casting nozzle according to claim 5, wherein the free edges of the first and second lateral surfaces join to form a rectilinear ridge.

10. Casting nozzle according to claim 9, wherein in a cut along a plane, fib, comprising said rectilinear ridge and bisecting the angle, α, formed by the first and second lateral surfaces the rectilinear ridge forms an angle, γ, with a normal projection of the longitudinal axis, X1, on said plane, fib, wherein γ has a value from and including 1° to and including 15°.

11. Casting nozzle according to claim 1, comprising two flow deflectors upstream from each port inlet.

12. Casting nozzle according to claim 5, wherein for any cut along a plane normal to the longitudinal axis, X1, intercepting the first and second lateral walls of a flow deflector, a first straight line originating at the free edge of, and extending normal to the first lateral surface of each flow deflector intercepts the middle plane, P1, in a section comprised between the longitudinal axis, X1, and the outer perimeter, and a second straight line originating at the free edge of, and extending normal to the second lateral surface of each flow deflector intercepts a central plane, P2, in a section comprised between the longitudinal axis, X1, and the outer perimeter, wherein the central plane, P2, includes the longitudinal axis, X1, and is normal to P1.

13. Casting nozzle according to claim 1, comprising a single flow deflector upstream from each port inlet.

14. Casting nozzle according to claim 5, wherein for any cut along a plane normal to the longitudinal axis, X1, intercepting the first and second lateral walls of a flow deflector, straight lines originating at the free edges of, and extending normal to the first and second lateral surfaces of each deflector intercept the middle plane, P1, in a first and second sections located on either sides of the longitudinal axis, X1, and disposed between the longitudinal axis, X1, and the outer perimeter.

15. Casting nozzle according to claim 1, further comprising two edge ports protruding out of the bore wall and extending upstream from the downstream bore end to above the level of the port inlet, the two edge ports facing each other and being located between the port inlets of the two side ports.

* * * * *